US008544542B2

(12) United States Patent
Buyers et al.

(10) Patent No.: US 8,544,542 B2
(45) Date of Patent: Oct. 1, 2013

(54) METHOD FOR SIGNALLING A DOWNHOLE DEVICE IN A WELL

(75) Inventors: Mark Buyers, Aberdeen (GB); David Forsyth, Aberdeen (GB)

(73) Assignee: Omega Completion Technology Ltd., Dyce (GB)

( * ) Notice: Subject to any disclaimer, the term of this patent is extended or adjusted under 35 U.S.C. 154(b) by 208 days.

(21) Appl. No.: 12/637,566

(22) Filed: Dec. 14, 2009

(65) Prior Publication Data

US 2010/0089570 A1 Apr. 15, 2010

Related U.S. Application Data

(62) Division of application No. 11/569,311, filed as application No. PCT/GB2005/001793 on May 11, 2005, now Pat. No. 7,673,680.

(30) Foreign Application Priority Data

May 19, 2004 (GB) ..... 0411121.7

(51) Int. Cl.
*E21B 43/12* (2006.01)
*E21B 47/06* (2012.01)

(52) U.S. Cl.
USPC ..... 166/250.07; 166/53; 166/66; 166/250.15

(58) Field of Classification Search
USPC ..... 166/53, 66, 319, 250.07, 250.15, 166/305.1
See application file for complete search history.

(56) References Cited

U.S. PATENT DOCUMENTS

| | | | | |
|---|---|---|---|---|
| 3,577,782 | A | 5/1971 | Aitken | |
| 3,800,277 | A | 3/1974 | Patton et al. | |
| 4,796,699 | A | 1/1989 | Upchurch | |
| 4,856,595 | A * | 8/1989 | Upchurch | 166/374 |
| 4,915,168 | A * | 4/1990 | Upchurch | 166/250.15 |
| 5,050,675 | A * | 9/1991 | Upchurch | 166/373 |
| 5,273,113 | A | 12/1993 | Schultz | |
| 5,355,960 | A | 10/1994 | Schultz et al. | |
| 5,412,568 | A | 5/1995 | Schultz | |
| 5,490,564 | A * | 2/1996 | Schultz et al. | 166/374 |
| 5,691,712 | A | 11/1997 | Meek et al. | |
| 5,887,657 | A | 3/1999 | Bussear et al. | |
| 6,021,095 | A | 2/2000 | Tubel et al. | |

(Continued)

FOREIGN PATENT DOCUMENTS

| | | | |
|---|---|---|---|
| EP | 0237662 | A1 | 9/1987 |
| EP | 0566382 | A1 | 10/1993 |

(Continued)

*Primary Examiner* — David Andrews
(74) *Attorney, Agent, or Firm* — Kirton McConkie; Evan R. Witt

(57) ABSTRACT

A method and apparatus for controlling the operation of a well which is not flowing or in which fluid is pumped or injected into the well utilising a downhole located pressure monitoring device which is operative to monitor a characteristic pressure profile of the well, and to respond and generate a triggering output when a significant deviation to the pressure profile is introduced into the well as a control signal to the monitoring device by comparing two separate pressure profiles within a certain time span, the device only generating a triggering output when the same pressure profile is monitored twice within the time span; and an actuator which is initiated into operation to control any required operation of the well when the monitoring device responds to the control signal and generates the triggering output.

14 Claims, 4 Drawing Sheets

(56) References Cited

U.S. PATENT DOCUMENTS

| | | | |
|---|---|---|---|
| 6,125,930 | A | 10/2000 | Moyes |
| 6,167,965 | B1 | 1/2001 | Bearden et al. |
| 6,776,240 | B2 | 8/2004 | Kenison et al. |
| 6,957,699 | B2 | 10/2005 | Feluch et al. |
| 7,055,598 | B2 | 6/2006 | Ross et al. |
| 7,171,309 | B2 | 1/2007 | Goodman |
| 2002/0043369 | A1 | 4/2002 | Vinegar et al. |
| 2002/0074118 | A1 | 6/2002 | Fisher |
| 2002/0195247 | A1 | 12/2002 | Ciglenec et al. |
| 2004/0035577 | A1 | 2/2004 | Ramakrishnan |
| 2004/0065477 | A1 | 4/2004 | Paulk et al. |

FOREIGN PATENT DOCUMENTS

| | | | |
|---|---|---|---|
| GB | 1547816 | | 6/1979 |
| GB | 2280013 | A | 1/1995 |
| GB | 2314863 | A | 1/1998 |
| GB | 2339226 | A | 1/2000 |
| GB | 2411677 | A | 9/2005 |
| GB | 2431943 | A | 5/2007 |
| WO | 9011429 | A2 | 10/1990 |
| WO | 90/13731 | A2 | 11/1990 |
| WO | 9705362 | A1 | 2/1997 |

* cited by examiner

METHOD FOR SIGNALLING A DOWNHOLE DEVICE IN A WELL

CROSS-REFERENCE TO RELATED APPLICATION

This application is a divisional application of U.S. application Ser. No. 11/569,311, filed Nov. 17, 2006, which was the National Stage of International Application No. PCT/GB2005/01793, filed May 11, 2005, which applications are incorporated by reference.

BACKGROUND

In the oil and gas industries, petrochemicals and hydrocarbon gases are extracted from deep in the earth through pressure bearing tubulars or "tubing". The tubing forms a conduit from the rock where the petrochemicals reside to the surface where it is terminated at the Wellhead or Christmas Tree. The wellhead is equipped with a number of valves to control and contain the pressure which is present in the tubing.

The oil or gas flows from source rock which may exist in a layer of just a few feet to many hundreds of feet. The quality and productivity of the rock may vary over distance and water or other undesirable elements may exist at certain points. Usually it is best practice to produce over the entire oil bearing interval and for any water to be produced along with the oil. Towards the latter stages of a well's life, the water production will generally increase at the expense of oil production. Production optimisation will depend on minimising the water production which will maximise the oil production.

Production may also be lost to "thief" zones. Thief zones are areas of rock penetrated by the wellbore which have less pressure than others. Crossflow can occur from a good high pressure zone to a poor low pressure zone. (See FIG. 1) Obviously, this is inefficient. Production optimisation will depend on isolating the thief zone until such time as the good high pressure zone has depleted to the extent that the pressure is the same or lower than the thief zone. Once the isolation has been removed, both zones may be allowed to flow to surface.

The production may initially be optimised by "shutting off" thief zones or water producing zones. Firstly, these zones must be identified and targeted. Instruments lowered into the wellbore on a wireline cable allow pressure, temperature, flow measurement and flow composition readings to be taken. Following analysis, a second intervention into the well may be conducted to mechanically close off the undesirable zone(s). A variety of equipment is available for this but most will dictate permanently closing off a part of the wellbore which action may be undesirable in later years.

A technology whereby the zones of a well may be individually opened or closed to help optimise the production from that well is called "smart well" technology. Differing zones are mechanically separated and isolated by packer assemblies (See FIG. 2). Flow from the zones is received through a valve which may allow on/off or incremental flow. Most of these valves feature a sleeve which uncovers flow ports in the outside diameter of the tool. Many of these valves may be installed in a well with surface control being provided by means of electric cables, hydraulic control lines or other means. Most smart well systems require a physical link from the bottom of the well or the valve apparatus to surface in order to provide hydraulic contact, electrical contact or both. Not only is this expensive, it becomes a source of unreliability. Failure of one part of this type of system may compromise all of the system. Obviously, the complexity (and unreliability) of the installation increases proportionally with the number of valves and the increase in control lines and/or electric lines, splices and connections.

Equipment which uses this type of physical link must be installed when the well is new. It is not capable of retrofitting into an existing well.

The ability to repeatedly open and close various zones from surface allows true optimisation without the need to intervene in the well for data collection or for installation of shut off equipment. Also, isolated zones may easily and quickly be re-opened for evaluation and potential production later in the life of the well or simply just for re-evaluation purposes.

Many wells are not suited to intervention techniques due to the great cost associated with these operations. These may be sub sea wells where no facilities exist to support the intervention, high pressure wells where safety is a prime consideration or remote wells where also, no facilities exist.

Recent innovations in the electro mechanical and acoustic fields have sought to mitigate the disadvantages of the physical link to surface and associated unreliability. These devices may offer a greater degree of flexibility and possibly higher reliability in the future. These technologies are as yet unproven and may have undesirable issues of their own such as limited range, high power consumption and lack of proven operation.

Accordingly, the present invention seeks to provide an alternative means of smart well operation with no boundaries of range and great service life due to low power consumption.

SUMMARY OF INVENTION

All wells possess a "pressure fingerprint", whether they are high pressure wells, injection wells, normally flowing wells, pumped wells or wells which are produced with other secondary recovery techniques such as gas lift. We refer to "pressure fingerprint" as being the pressure characteristics of a particular well which are bestowed as a function of the nature of the fluid in the wellbore, the ratio of oil to gas or other fluids/gasses, the reservoir pressure, the diameter and length of the production tubing and the choke or orifice size used at surface to restrict the well flow for processing purposes. All these factors conspire to provide an individual pressure profile or performance characteristics for a particular well which will differ from most other wells.

The invention may recognise an event deliberately applied to change the pressure fingerprint in order that recognition of that event be used as the trigger to activate a device positioned in the wellbore or at the bottom of the well.

The pressure signature of a well can be changed in many ways. When a well is shut in, both the bottom hole (BHP) and the surface wellhead pressure (WHP) will increase. (See FIG. 3) The increase will initially be rapid but will tail off as stabilisation occurs after some time. The increase witnessed will substantially be the same both downhole and at surface.

The invention may be programmed to measure and record this build up curve or a number of compared curves but in signalling the device, production will be lost and the process equipment may become upset due to large dynamic changes. Accordingly, shutting in a well in order to generate an operating signal or trigger is not attractive. The techniques of pressure measurement downhole with quartz, strain, silicon and sapphire technologies are well known to one versed in the art as are the processing and memory functions also required for operation of the device.

When a well is opened to allow flow, both BHP and WHP will drop a similar amount, rapidly first and then stabilise with time (See FIG. 4). When a well is flowing through a restriction (or choke) at surface of a certain size and the flow is subsequently diverted through another smaller choke, both BHP and WHP will increase as previously described but fractionally compared with shutting off the flow completely (See FIG. 5). A well which is flowing through a one inch choke might typically exhibit a pressure increase of 200 psi (both downhole and at surface) when flow is diverted through a three quarter inch choke. The majority of the 200 psi increase will occur within the first fifteen minutes following the change. This will provide a discrete and recognisable event which may be recorded for comparison with later events.

It is possible that the applied event (choking the well) may be confused with normal operational events of a similar nature. To prevent this, the invention compares events which are being monitored with previously monitored events. One possible configuration is to programme the device such that triggering output will only be allowed when exactly the same event is monitored twice within a certain time span. For example, the device will monitor events (BHP) from a time, say 12 noon, each day for one hour only. If during the one hour listening period, the programmed "event profile" is matched on both days, then triggering output would result. This condition may be satisfied by producing the well on a smaller choke for a short period starting just after 12 noon. Following this the well may be produced back on the normal choke until the next day when the exact same process may be repeated. Comparison of the second event with the first may allow triggering of the device if the required conditions are satisfied. The pressure profile of a choke change has been chosen for this example in that it is sufficiently distinctive as to avoid confusion with other operational constraints.

Additionally, thresholds may be applied to prevent erroneous operation. The thresholds may comprise a plus and minus pressure band allowing for stability checks prior to any other measurement. The slope of the pressure increase (pressure versus time) and extent of the pressure increase may be set within limits to further tune the system to prevent activation from erroneous data.

As battery power is finite for this type of equipment, normally, the equipment would be dormant save for the one hour daily when it must listen for the signal. Additionally, as there will in all probability be more than one device of this nature in a well, the individual devices may be programmed with differing listening times. Selective operation may be achieved by executing the required surface event (choke change) at times corresponding to the pre programmed listening times of the individual devices. For a four device installation, listening periods may be staggered by six hour intervals.

Although a principle mode of operation is one of altering the dynamic properties of a flowing well, situations may occur for safety or other reasons where the well is not flowing but operation of the devices is required. It is well known that pumping fluid or injecting into a well has the effect of increasing the pressure. This action will have the same effect as the previously described choke change in that if correctly timed, it may be recognised by the listening device. Pumping a known volume over a known time beginning at a particular time on two consecutive days may be recognised by the device allowing it to trigger. Similarly in water injection wells where no product is produced from the well but where water is pumped down in order to maintain the pressure in an oil field, alteration of the pump rate or choking of the flow into the well will qualify as a recognisable signal to the device provided that the previously detailed parameters are satisfied.

Occasionally wells demonstrate a condition known as slugging. A slugging well flow alternates between production of mostly oil to production of mostly gas. The pressure profile of these wells is often wave like. As the gas is released, the BHP drops slightly. As the oil slug makes its way up the tubing and more oil enters from below, the BHP increases until the oil is produced at surface and the hydrostatic pressure in the wellbore is reduced. Accordingly, the BHP drops quickly. The cycle then repeats itself. The well head pressure does not track the bottom hole pressure in a slugging well unlike as has previously been described.

Slugging wells may be characterised by constantly changing pressure which demonstrates the need for an initial stability band within the device. Changing choke on a slugging well will in all probability not provide the recognisable signal which the device requires. In this circumstance, the well must be shut in and allowed to stabilise and fluid or gas must be pumped down the well under the same conditions on two consecutive days at the same time each day in order to trigger output from the device.

Some wells are mechanically pumped or are lifted by injecting gas at some depth in the well. A pumped well may provide a recognisable pressure signature simply by switching off the pump at the appropriate time on consecutive days. Similarly, gas lift wells may have their gas flow interrupted or substantially increased in order to provide recognisable criteria.

DESCRIPTION OF PREFERRED EMBODIMENTS OF THE INVENTION

Figure 1:
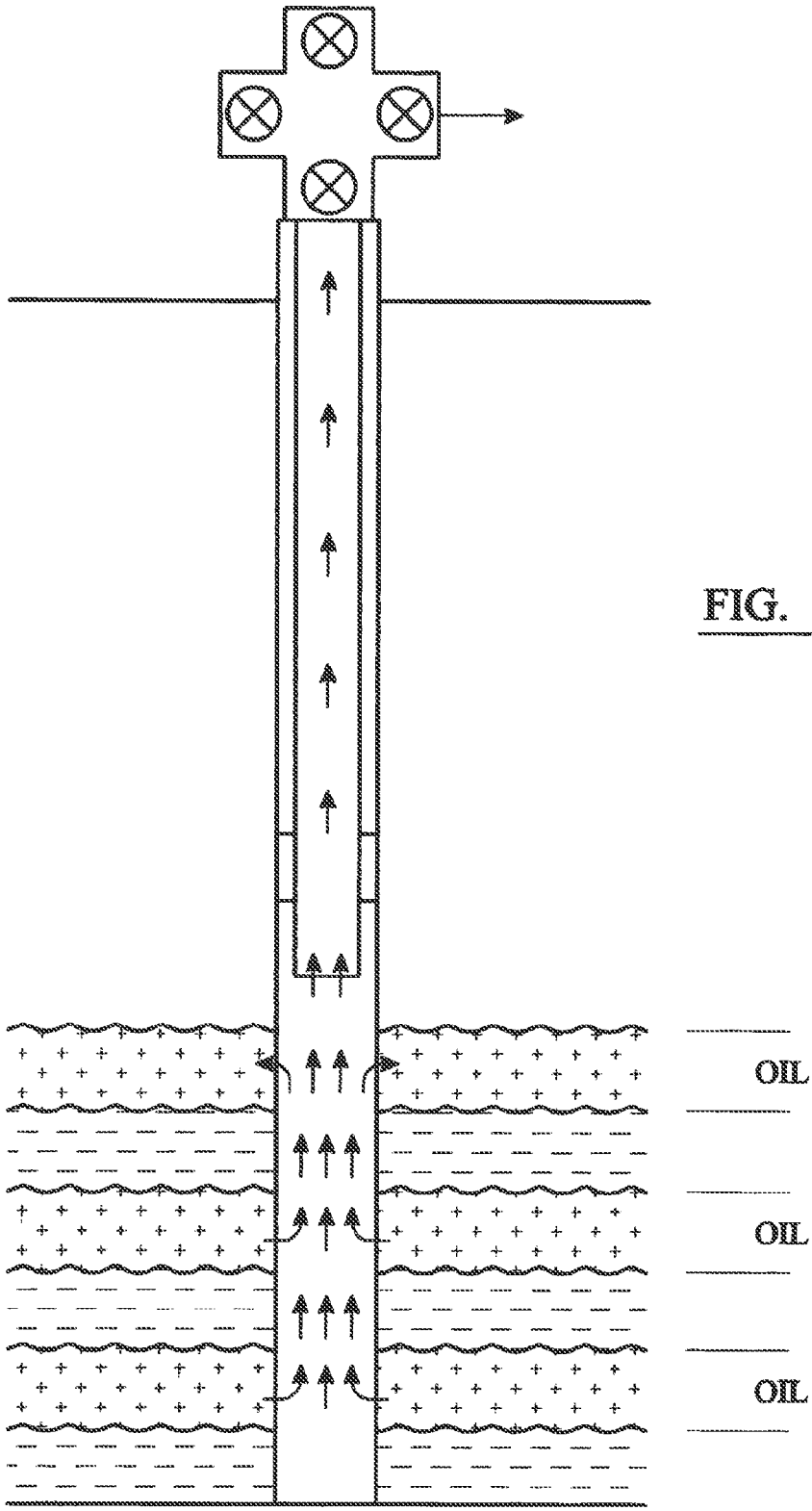
FIG. 1 is a cross-sectional schematic representation of an oil or gas well and associated underground rock formations.
Figure 2:
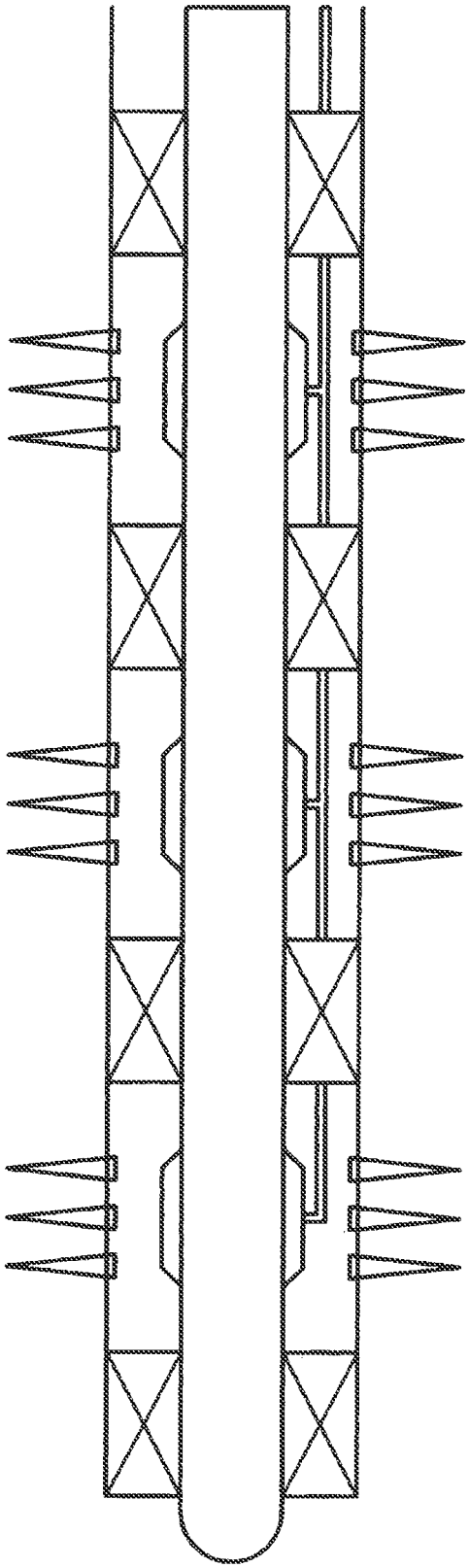
FIG. 2 is a schematic representation of packer assemblies that mechanically separate and isolate zones within a wellbore.
Figure 3:
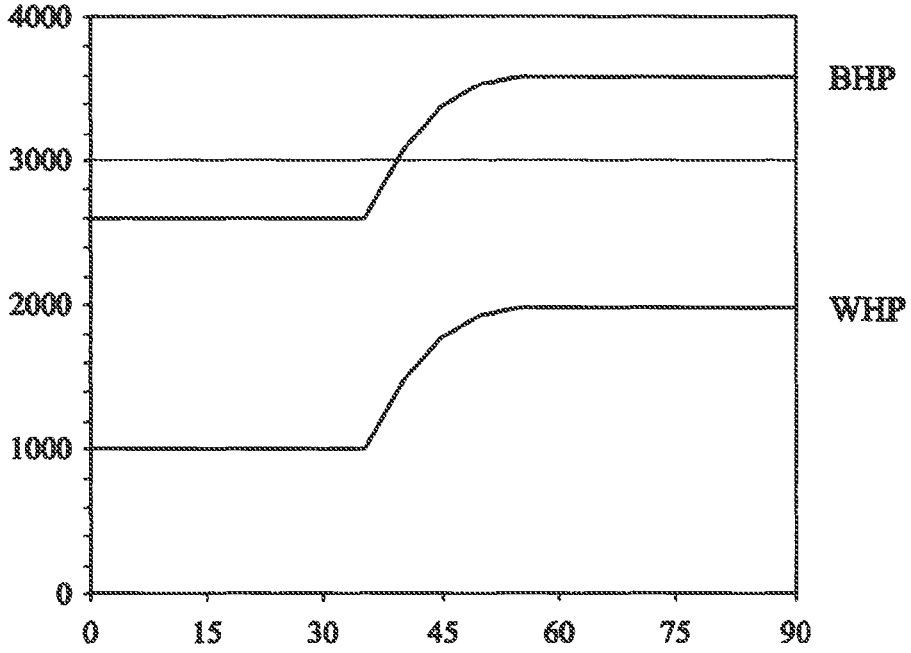
FIG. 3 is a graph of pressure versus time showing the increase in bottom hole pressure (BHP) and wellhead pressure (WHP) when a well is shut.
Figure 4:
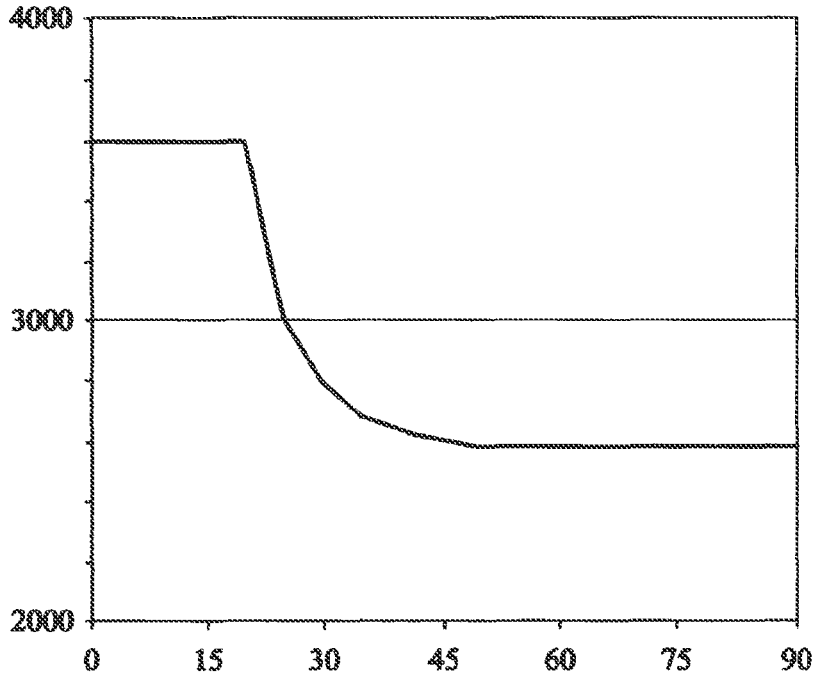
FIG. 4 is a graph of pressure versus time showing the decrease in bottom hole pressure (BHP) when a shut well is opened to allow flow.
Figure 5:
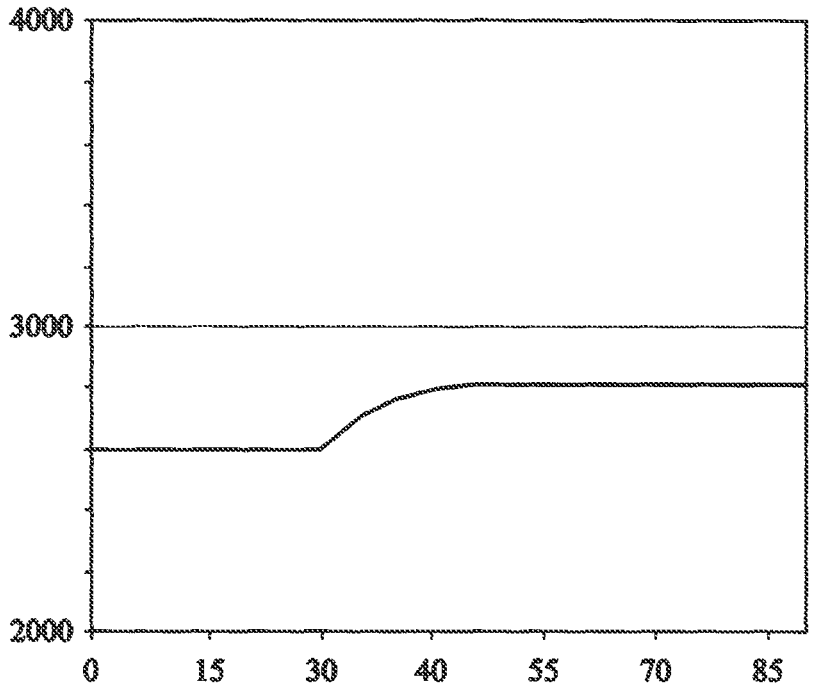
FIG. 5 is a graph of pressure versus time showing the increase in bottom hole pressure (BHP) when a well flowing through a restriction is diverted through a smaller restriction.

A pressure transducer device which is battery powered is housed in a pressure tight container. Also within the housing are batteries, preferably of the long life high density lithium variety, a micro processor and associated P.C.B., a memory portion for storage of the operating programme, a second memory provision for storage of the pressure history from the previous day, a high accuracy quartz oscillator to provide reference for a real time clock and one or more output actuators.

The device will monitor well pressure at a particular time each day for a set period such as one hour. The device will store pressure measurements taken during the period for comparison with other measurements taken in the subsequent period. In the event that the subsequent measurements plus previous measurements conform to a pre programmed profile contained within the tool, an output action will be allowed. T his may be operation of an actuator or similar.

The device may be packaged along with a valve type apparatus which may be used to close off the flow from a particular wellbore zone but may also be used for a variety of other purposes. A valve apparatus may be electrically actuated, may be electro-hydraulic or may be purely hydraulic. Simple operating types will generally be of the on/off variety requiring two outputs from the invention. Logic within the device will record the current status of the output actuator(s) and will provide the opposite in recognition of the next signal, i.e., opening will follow closure and closure will follow opening. Signalling to the device from surface may entail the same process in both cases.

Operation of a hydraulic device may be accomplished by actuating open a pilot valve for a period of time which allows well pressure to act on a piston. The piston may be housed in a sealed chamber with atmospheric pressure acting on the opposing face. The piston may be linked to the valve sleeve and upon receiving actuating pressure from the well, the piston will stroke and in so doing will close the valve sleeve. Opening the valve device will comprise a similar but reverse acting mechanism. The atmospheric side of the piston will be switched to reference well pressure and the previously well pressure referenced side will be switched to atmospheric pressure. The atmospheric pressure chamber will be required to contain a decent volume as with multiple use, the pressure within the chamber will increase.

An option to control a multi position device exists whereby the listening hour may be subdivided into, say, three individual twenty minute periods. Recognition of a signal in the first period on both days may correspond to an output from the device which allows ⅓ opening of the downhole valve. Recognition of a signal in the second period within the hour on both days may correspond to ⅔ opening of the device and the third period on both days, full opening.

The scope for a number of increased output options exists where recognition in one of the three twenty minute first day periods coupled with recognition in one of the three twenty minute second day periods (but still within the listening hour) may be recognised. The nine permutations achieved by selecting one of the three available first and one of the three available second day periods within the listening hour may correspond to nine different pre-programmed outputs. Accordingly, a device with nine operational positions may then be signalled and controlled. As before, with a one hour listening period, a maximum number of twenty four of these devices may be positioned in a wellbore (one for each hour) and each function independently of each other. Advantageously, malfunction of one or more will not affect the operation of the remaining devices.

Many other types of well equipment may benefit from use of the signalling method. One example is for use as a safety valve. Normal operation of a well will comprise flowing the well at maximum output without any interruption in order to maximise economic returns from the well. Upon receipt of a platform or facilities alarm, a safety system will be tripped shutting all wells both at surface and at a downhole valve called a safety valve. Should the safety valve be replaced by a device according to the invention, closure may be accomplished by recognition of only one signal. The signal required may be a number of pressure measurements above a pre set pressure threshold such as would be demonstrated when a well is shut in at surface. In this instance, the well would be shut in at surface by the normal facilities system. The well pressure would build up downhole and this feature would be recognised by the device minutes later. The device would then actuate a valve shut off device which would close off the lower portion of the well.

Upon conclusion of the emergency situation, there would be a need to produce the well again and accordingly to open the valve which is closing off the well. In addition to the programmed pressure threshold to close the device, it would additionally have an opening programme. This may compare pressure traces over two hours for example and identify a definite event which may only be a deliberate action from the part of the production operator. This might be pumping into the well and bleeding back at the same point of each hour twice. Recognition of this event will serve to trigger actuation open of the invention.

There is disclosed a new and inventive method and apparatus for controlling the operation of a flowing or producing well, whereby a control or actuating signal is transmitted to a downhole tool without any physical link to that tool.

There are many known method of communicating to downhole tools by providing a signal from the surface. These may be electronic, acoustic, electromagnetic, use dedicated hydraulic control lines or dedicated electrical cables, or may be pressure pulses which are applied to the wellbore, the wellbore annulus (the annular area between the production tubing and the casing) or a mixture of both.

The invention allows a command to be detected, not by application of some external input using one of the above techniques, but by changing the existing dynamics of a well synchonised with time.

There is disclosed a method of signalling from surface to a remote device disposed in a producing oil or gas borehole comprising: surface means for restricting flow; surface time indication means synchronised with:

Downhole electronics module comprising; real time monitoring means; pressure sensing means for sensing pressure changes; temporary memory means to store recent pressure history; multi processor means to control and schedule operation of the device, to match separate profiles of present and recent pressure history, to execute activation programme upon detection of matching profiles and to store defined logic/profile parameters;

battery means to provide electrical power to the device;

actuatory means to execute the received command;

whereby the dynamic properties of a flowing well are altered in order to provide a recognisable signal, detectable by the downhole device.

There is also disclosed a method for signalling from surface to a remote device disposed in a producing oil or gas borehole comprising:

surface means for restricting flow, surface time indication means synchronised with:

downhole electronics module comprising, real time monitoring means, pressure sensing means for sensing pressure changes, temporary memory means to store recent pressure history, multi processor means to control and schedule operation of the device, to match separate profiles of present and recent pressure history, to execute activation programme upon detection of matching profiles and to store defined logic/profile parameters, battery means to provide electrical power to the device, actuator means to execute the received command, whereby the dynamic properties of a flowing well are altered in order to provide a recognisable signal, detectable by the downhole device.

There is also disclosed a method and apparatus for controlling the operation of a flowing or producing well utilising:

a downhole located pressure monitoring device which is operative to monitor a characteristic pressure profile of the flowing well, and to respond when a significant deviation to the pressure profile is introduced into the well as a control signal to the monitoring device; and an actuator which is initiated into operation to control any required operation of the well when the monitoring device responds to the control signal.

Therefore, a significant improvement is provided whereby two separate pressure profiles are compared.

Conveniently, there is provision of means for utilising a non-predetermined signature.

If desired, the actuator is arranged to operate a flow control valve, or may be arranged to initiate an explosive charge if required.

A clock (not real time) may be arranged to compare events at predetermined intervals e.g. every three, five or seven hours, to correct for any possibility of "drift" with a real time clock which otherwise would result in the control signal being sent when the clock was not "listening".

In a particularly preferred arrangement according to the invention, a self-learning capability is provided, by storage of any pressure profile for comparison with a later pressure profile for a finite time period.

There is also disclosed a method for signalling from surface to a remote device disposed in a producing oil or gas borehole, for control of the production of fluids or gas from a discrete area of the producing formation allowing communication whilst producing fluids substantially uninterrupted comprising :

surface means for restricting flow, surface time indication means synchronised with:

downhole electronics module comprising, time monitoring means to compare present readings from pressure sensing means with recent readings from pressure sensing means, pressure sensing means for sensing pressure changes, temporary memory means to store recent pressure history, multi processor means to control and schedule operation of the device to match separate profiles of present and recent pressure history, to execute activation programme upon detection of matching profiles and to store defined logic/profile parameters, battery means to provide electrical power to the device and actuator, valve means to allow opening or closure of flow from the discrete area of the formation rock into the wellbore.

one or more actuator means to operate the valve packer means to provide pressure isolation of a discrete area of the formation rock from other areas.

The method may be arranged so as to transmit a signal to a device located in a wellbore.

In an aspect of the present invention, there is provided a method for controlling the operation of a well which is not flowing or in which fluid is pumped or injected into the well as described herein.

In another aspect of the present invention, there is provided apparatus for controlling the operation of a well which is not flowing or in which fluid is pumped or injected into the well as described herein.

The invention claimed is:

1. A method for controlling the operation of a well which is not flowing or in which fluid is pumped or injected into the well, the method utilising:

a downhole located pressure monitoring device which is operative:

to monitor a characteristic pressure profile of the well; and to respond and generate a triggering output when a significant deviation to the pressure profile is introduced into the well as a control signal to the monitoring device by comparing two separate pressure profiles within a certain time span, the device only generating a triggering output when the same pressure profile is monitored twice within the time span; and an actuator which is initiated into operation to control any required operation of the well when the monitoring device responds to the control signal and generates the triggering output.

2. A method according to claim 1, and arranged to transmit a signal to a device located in a wellbore.

3. A method according to claim 1, which utilises a non-predetermined signature.

4. A method according to claim 1, in which the actuator is arranged to initiate an explosive charge.

5. A method according to claim 1, including a clock (not real time) arranged to compare events at a predetermined interval to correct for any possibility of drift with a real time clock which otherwise would result in the control signal being sent when the clock was not "listening".

6. A method according to claim 1, including a self-learning capability by storage of any pressure profile for comparison with a later pressure profile for a finite time period.

7. A method according to claim 2, which utilises a non-predetermined signature.

8. A method according to claim 7, in which the actuator is arranged to initiate an explosive charge.

9. A method according to claim 8, including a clock (not real time) arranged to compare events at a predetermined interval to correct for any possibility of drift with a real time clock which otherwise would result in the control signal being sent when the clock was not "listening".

10. A method according to claim 9, including a self-learning capability by storage of any pressure profile for comparison with a later pressure profile for a finite time period.

11. A method according to claim 5, wherein the predetermined interval is selected from three hours, five hours, or seven hours.

12. A method according to claim 9, wherein the predetermined interval is selected from three hours, five hours, or seven hours.

13. Apparatus for controlling the operation of a well which is not flowing or in which fluid is pumped or injected into the well, and the apparatus comprising:

a downhole located pressure monitoring device which is operative:

to monitor a characteristic pressure profile (pressure fingerprint) of the well; and to respond and generate a triggering output when a significant deviation to the pressure profile is introduced into the well as a control signal to the monitoring device by comparing two separate pressure profiles within a certain time span, the device only generating a triggering output when the same pressure profile is monitored twice within the time span; and an actuator which is initiated into operation to control any required operation of the well when the monitoring device responds to the control signal and generates the triggering output.

14. Apparatus according to claim 13, in which the actuator comprises a flow control valve.

* * * * *